US005682828A

United States Patent [19]

Phalen et al.

[11] Patent Number: 5,682,828

[45] Date of Patent: Nov. 4, 1997

[54] FLUIDIZED BED COMBUSTION SYSTEM AND A PRESSURE SEAL VALVE UTILIZED THEREIN

[75] Inventors: John W. Phalen, Somerville, N.J.; Stephen J. Goidich, Palmerton, Pa.

[73] Assignee: Foster Wheeler Energy Corporation, Clinton, N.J.

[21] Appl. No.: 434,872

[22] Filed: May 4, 1995

[51] Int. Cl.[6] ..... F23G 5/00

[52] U.S. Cl. ..... 110/245; 165/104.16; 122/4 D; 110/263

[58] Field of Search ..... 110/245, 263, 110/348, 341, 216; 122/4 D; 165/104.16

[56] References Cited

U.S. PATENT DOCUMENTS

| | | | |
|---|---|---|---|
| 4,594,967 | 6/1986 | Wolowoduik . | |
| 4,640,201 | 2/1987 | Holmes et al. . | |
| 4,679,511 | 7/1987 | Holmes et al. . | |
| 4,788,919 | 12/1988 | Holm et al. . | |
| 4,947,804 | 8/1990 | Abdulally . | |
| 5,040,492 | 8/1991 | Dietz . | |
| 5,054,436 | 10/1991 | Dietz . | |
| 5,069,170 | 12/1991 | Gorzegno et al. . | |
| 5,069,171 | 12/1991 | Hansen et al. . | |
| 5,141,708 | 8/1992 | Campbell, Jr. et al. | 110/245 X |
| 5,181,481 | 1/1993 | Dietz . | |
| 5,215,042 | 6/1993 | Beisswenger et al. . | |
| 5,239,946 | 8/1993 | Garcia-Mallol . | |
| 5,253,741 | 10/1993 | Gorzegno . | |
| 5,269,263 | 12/1993 | Garcia-Mallol | 122/4 D |
| 5,471,955 | 12/1995 | Dietz | 122/4 D |

*Primary Examiner*—Henry A. Bennett
*Assistant Examiner*—Susanne C. Tinker
*Attorney, Agent, or Firm*—Haynes and Boone, L.L.P.

[57] ABSTRACT

A fluidized bed combustion system in which a separator receives a mixture of flue gases and entrained particulate separated material from a fluidized bed in a furnace. A pressure seal valve connects an outlet of the separator to the furnace or a fluidized bed heat exchanger disposed adjacent the furnace for recycling the separated particulate separated material back to the furnace. The pressure seal valve includes a downflow leg, and upflow leg and a horizontal leg connecting the downflow leg to the upflow leg. A horizontal overflow leg is connected to the upflow leg and at least two return legs connect the overflow leg to the furnace. The separated material from the separator passes through the legs of the pressure seal valve and sometimes through a heat exchanger (if included) before reentering the furnace.

10 Claims, 2 Drawing Sheets

FLUIDIZED BED COMBUSTION SYSTEM AND A PRESSURE SEAL VALVE UTILIZED THEREIN

This invention relates to a fluidized bed combustion system and a pressure seal valve utilized therein, and, more particularly, to such a system and valve in which the valve is provided between the furnace section and the separating section of the fluidized bed combustion system.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and stabilizing the sulfur emissions at a low level. The external solids recycling is achieved by disposing a cyclone separator at the furnace outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence time reduces the adsorbent and fuel consumption.

In the circulating fluidized bed arrangements, it is important that a pressure seal be provided between the separator and the furnace to prevent backflow of gases, with entrained solids, directly from the furnace to the outlet of the separator. Previous arrangements have utilized various forms of loop seal valves, such as a "J-valve" which has a vertical portion extending from the dipleg of the separator and a U-shaped portion extending from the vertical portion to create the pressure seal. J-valves of this type usually feature a downflow leg, a horizontal leg an upflow leg, an overflow leg and a return leg, with the respective dimensions of the legs being such that the height of the solids in the downflow leg directly corresponds to the sum of the pressure drops across the furnace and the separator. U.S. Pat. No. 4,947,804 and U.S. Pat. No. 5,040,492, both assigned to the assignee of the present invention, disclose the use of a J-valve of this type.

As the combustion systems become larger, either the size of the cyclone separator, or the number of the separators must be increased, to maintain a constant velocity in the separator. In order to minimize the additional costs involved, most designs keep the number of separators to a minimum and use larger separators. However, since a single J-valve is associated with each separator, the solids from the separator are returned to the furnace at only one point per separator. In large systems, this will cause a maldistribution of solids in the furnace and detrimentally affect heat distribution and emissions. Moreover, in these type of arrangements a plurality of aeration taps and associated controls are required in connection with the pressure seal valve which adds to the cost and complexity of the system.

SUMMARY OF THE INVENTION

It is therefore an object of the present invention to provide a fluidized bed combustion system and a pressure seal valve utilized therein.

It is a further object of the present invention to provide a system and valve of the above type in which the valve is in the form of a J-valve.

It is a still further object of the present invention to provide a system and valve of the above type in which the solids from the separator are distributed to the furnace at multiple return points.

It is a still further object of the present invention to provide a system and valve of the above type which reduces the number of aeration taps and controls associated with the valve.

It is a still further object of the present invention to provide a system and valve of the above type in which the valve receives separated material from the separator and returns it to the furnace at multiple points.

Towards the fulfillment of these and other objects, a fluidized bed combustion system is provided in which a separator receives a mixture of flue gases and entrained particulate material from the fluidized bed in the furnace and separates the particulate material from the flue gases. A pressure seal valve connects the outlet of the separator to the furnace for passing the separated material from the separator to the furnace. The valve includes a split return leg to increase the number of return points to the furnace.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings in which.

DESCRIPTION OF THE PREFERRED EMBODIMENT

Figure 1:
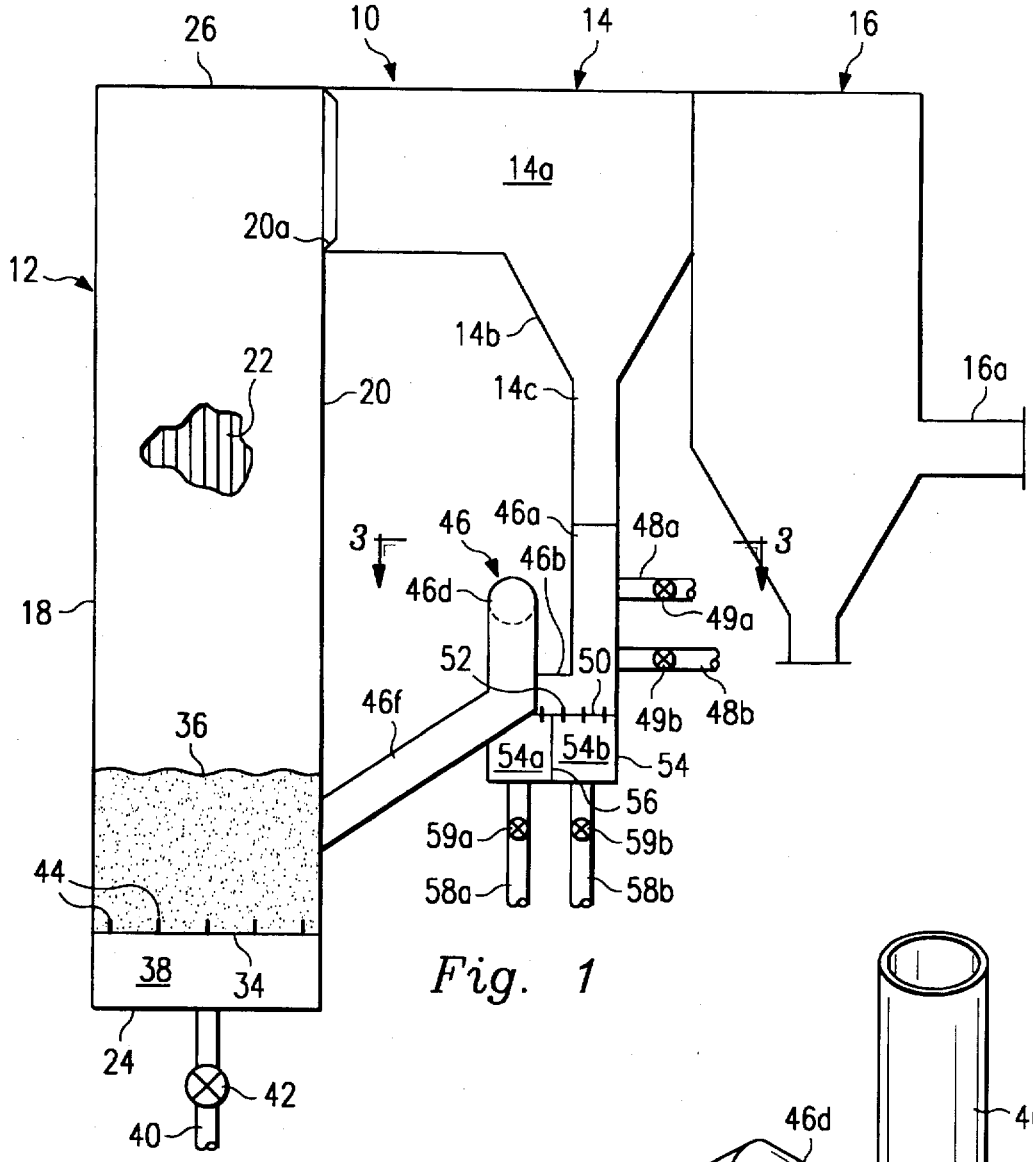
FIG. 1 is a schematic representation of the fluidized bed combustion system and the pressure seal valve of the present invention.

A preferred embodiment of the combustion system of the present invention is shown in FIG. 1 of the drawings and includes a fluidized bed reactor which is referred to, in general, by the reference numeral 10. The reactor 10 includes a furnace section 12, a separating section 14 and a heat recovery section 16, all shown with their internal components removed for the convenience of presentation. The furnace section 12 is defined by a front wall 18, a rear wall 20, two sidewalls, one of which is shown by the reference numeral 22, a floor 24 and a roof 26.

An opening 20*a* is provided in the upper portions of the wall 20 for permitting combustion flue gases produced in the furnace section 12 to pass from the furnace section into the separating section 14. It is understood that proper ducting (not shown) is provided to permit the separated gases to pass from the separating section to the heat recovery section, as will be explained.

It is understood that if the reactor 10 is used for the purpose of steam generation, the walls 18, 20, and 22, the floor 24 and the roof 16 of the furnace section 12, as well as the walls and roof of the sections 14 and 16, would be formed by a plurality of heat exchange tubes formed in a parallel, gas tight manner to carry the fluid to be heated, such as water. These tubes are shown schematically in the drawing with reference to the sidewall 22 of the furnace section 12. It is also understood that a plurality of headers (not shown) would be disposed at both ends of each of the aforementioned walls which, along with additional tubes and associated flow circuitry, would function to route the water through the interior of the reactor and to and from a steam drum (not shown) in a conventional manner. These components are omitted in the drawings for the convenience of presentation.

A grid 34 extends horizontally in the lower portion of the furnace section 12 and is formed by a plurality of spaced, parallel water tubes joined by fins as shown and described in U.S. Pat. No. 4,418,650 assigned to the assignee of the present invention. A bed of particulate material, shown in general by the reference numeral 36, is disposed within the furnace section 12 and rests on the grid 34. The bed 36 can consist of discrete particles of fuel material, such as bituminous coal, which are introduced into the furnace section 12 by a feeder or the like in any known manner. It is understood that a sulfur adsorbing material, such as limestone, can also be introduced into the furnace section 12 in a similar manner which material adsorbs the sulfur generated by the burning coal.

It is also understood that a bed light-off burner (not shown) is mounted in duct 40 for preheating the bed 36 to the fuel ignition temperature during start-up.

A plenum 38 is defined between the grid 34 and the floor 24 and receives pressurized air from an external source via air conduit 40 under control of a damper 42. A plurality of nozzles 44 extend through perforations provided in the fins of the grid 34 and are adopted to discharge air from the plenum 38 into the bed 36. The air passing through the bed 36 fluidizes the bed to promote combustion of the fuel and combines with the products of combustion to form flue gases which rise by convection in the furnace section 12. The flue gases entrain a portion of the relatively fine particulate material in the furnace section 12 before passing, via the opening 20*a*, into the separating section 14.

The separating section 14 includes a cyclone separator 14*a* which functions in a conventional manner to separate the entrained particulate material from the flue gases. The separated flue gases pass, in the manner described above, to the heat recovery section 16. It is understood that one or more heat exchange units, such as a superheater, reheater or the like can be provided in the heat recovery section 16 for removing the heat from the separated flue gases as they pass downwardly in the section 16 before exiting from the section 16 through an outlet 16*a*.

The separated particulate material passes from the separator 14*a* into a hopper 14*b* of the separating section 14. A dipleg 14*c* extends downwardly from the hopper 14*b* of the separating section 14 to a pressure seal valve, shown in general by the reference numeral 46, for preventing the backflow of particulate material and/or gases directly from the furnace section 12 to the separating section 14. The valve 46 is shown in detail in FIGS. 2 and 3 and consists of a plurality of legs 46*a*–46*f*, each in the form of a conduit, or duct. The leg 46*a* extends vertically with its upper end connected to the lower end of the dipleg 14*c*, and its lower end connected to an end of the leg 46*b* which extends horizontally. The other end of the leg 46*b* is connected to the lower end of the leg 46*c* which extends vertically and parallel to the leg 46*a*. The upper end of the leg 46*c* registers with an opening formed in the wall of the leg 46*d*, the center portion of which extends horizontally and the end portions of which are angled downwardly as viewed in FIG. 2. Corresponding ends of the legs 46*e* and 46*f* are respectively connected to the ends of the leg 46*d*. The leg portions 46*e* and 46*f* are angled downwardly from the leg 46*d* and are connected directly to the furnace section 12, as will be described.

A pair of air inlet conduits 48*a* and 48*b* (FIG. 1) register with the leg 46*a* for receiving air from an external source and introducing the air into the latter leg under the control of two dampers 49*a* and 49*b*, respectively disposed in the conduits. The lower boundary of the horizontal leg 46*b* is formed by a perforated air distribution plate 50 and a plurality of air nozzles 52 extend through the perforations. A plenum 54 extends below the plate 50 and is divided into two sections 54*a* and 54*b* by a partition 56. Two air inlet conduits 58*a* and 58*b* receive pressurized air from an external source (not shown) and distribute the air to the plenum sections 54*a* and 54*b*, respectively under control of two dampers 59*a* and 59*b* disposed in the conduits 58*a* and 58*b*, respectively. As a result, the air discharges through the nozzles 52 into the horizontal leg 46*b*. The discharge of air into the valve 46 via the conduits 48*a*, 48*b*, 58*a*, and 58*b* promotes the flow of particulate material through the valve 46, as will be further described. It is understood that the use of two air inlet conduits associated with each leg is for the purpose of example only, and that the number of air conduits employed can vary within the scope of the invention.

In operation, particulate fuel material and adsorbent are introduced into the furnace section 12 and accumulate on the grid 34. Air from an external source passes into the plenum 38 via the air conduit 40, through the grid 34, and the nozzles 44 and into the particulate material supported by the grid to fluidize the bed 36.

The light-off burner (not shown) or the like is fired to ignite the particulate fuel material in the bed 36. When the temperature of the material in the bed 36 reaches a predetermined level, additional particulate material is continuously discharged onto the upper section of the bed. The air promotes the combustion of the fuel and the velocity of the air is controlled by the damper 42 to exceed the minimum fluidizing velocity of the bed 36 to form either a bubbling, circulating or hybrid fluidized bed.

As the fuel burns and the adsorbent particles are reacted, the continual influx of air through the nozzles 44 creates a homogenous fluidized bed of particulate material including unburned fuel, partially-burned fuel, and completely-burned fuel along with unreacted adsorbent, partially-reacted adsorbent and completely-reacted adsorbent.

The gaseous products of combustion pass upwardly through the bed 36 and entrain, or elutriate, the relatively fine particulate material in the bed. The resulting mixture passes upwardly in the furnace section 12 by convection before it exits the furnace section through the opening 20*a* and passes into the separating section 14*a* which functions in a conventional manner to separate the entrained particulate material from the combustion gas. The separated particulate material then falls, by gravity, into the hopper 14*b* from which it passes through the dipleg 14*c* and into the leg 46*a* of the valve 46. The material then flows through the horizontal leg 46*b* and into the leg 46*c* before building up in height and entering the leg 46*d*. The material builds up in, and discharges from, the leg 46*d* into the return legs 46*e* and 46*f* before passing through the openings in the wall 20 and into the furnace section 12.

During this flow of the particulate material through the valve 46, air is passed, via the conduits 58*a* and 58*b*, under control of the dampers 59*a* and 59*b*, and through the nozzles 52 to aerate the material in the horizontal leg 46*b*. This, along with the air from the conduits 48*a* and 48*b*, which is introduced into the vertical leg 46*a* under control of the dampers 49*a* and 49*b*, respectively, promotes the above flow, while gravity assists the downward flow of the particulate material from the valve legs 46*d*, 46*e* and 46*f* into the furnace section 12. The rate of this recycling is varied in any conventional manner, such as by varying the fluidizing air velocity through the nozzles 44 to vary the amount of solids transported to the separating section. The height of the separated solids in the leg 46*a* builds up to a level corresponding to the sum of the pressure drop across the furnace and the separators and thus act as a pressure seal between the opening(s) in the wall 20 of the enclosure 12 and the hopper 14*b*.

The relatively clean combustion gas passes from the separating section 14*a* pass into the heat recovery section 16 and through the latter section before exiting the reactor 10 via the outlet 16*a*.

The valve 46 has several advantages. For example, it creates a non-mechanical pressure seal which prevents the backflow of particulate material from the furnace to the separator. Further, the provision of the two return legs 46*e* and 46*f* provides a more uniform distribution of solids in the furnace and thus improves heat distribution and emissions while reducing the number of aeration taps and controls.

Figure 2:
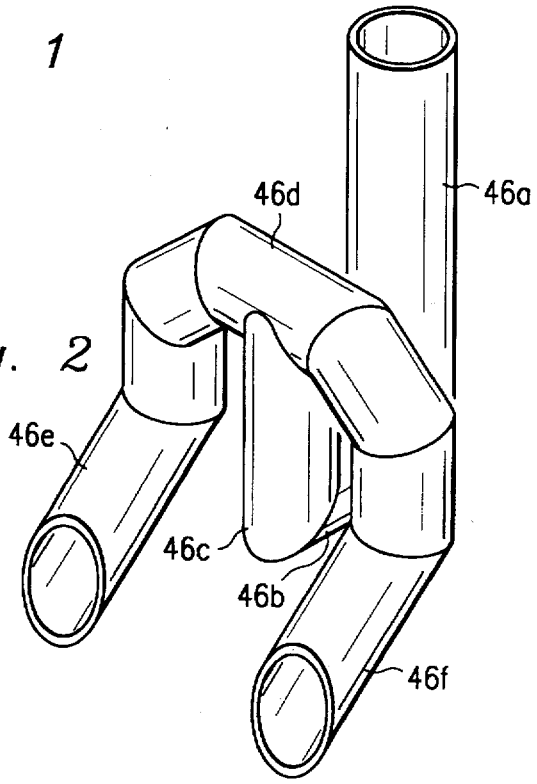
FIG. 2 is a perspective view of the pressure seal valve of the present invention.
Figure 4:
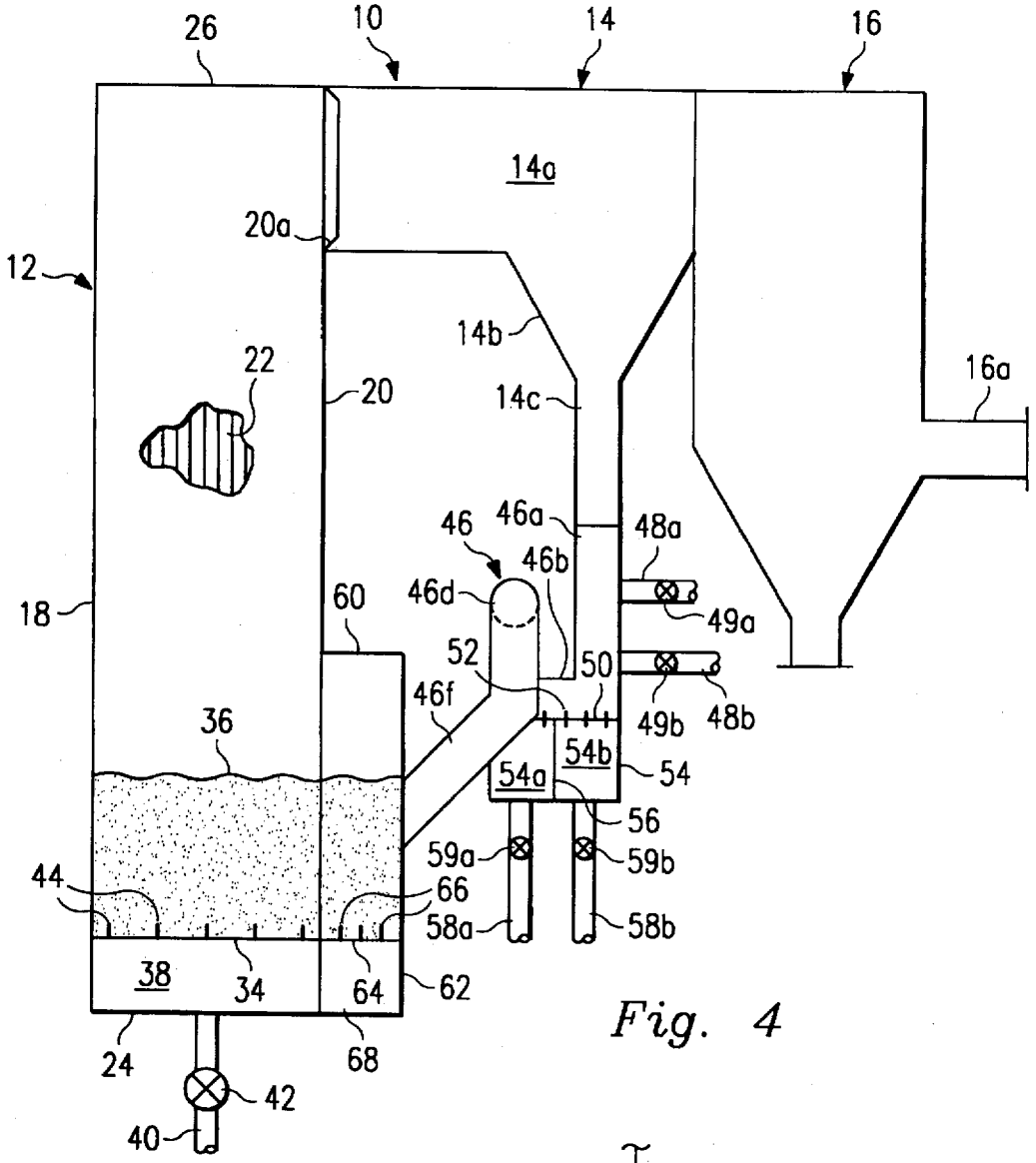
FIG. 4 is a view similar to FIG. 1, but depicting an alternate embodiment of the fluidized bed combustion system of the present invention.
Figure 3:
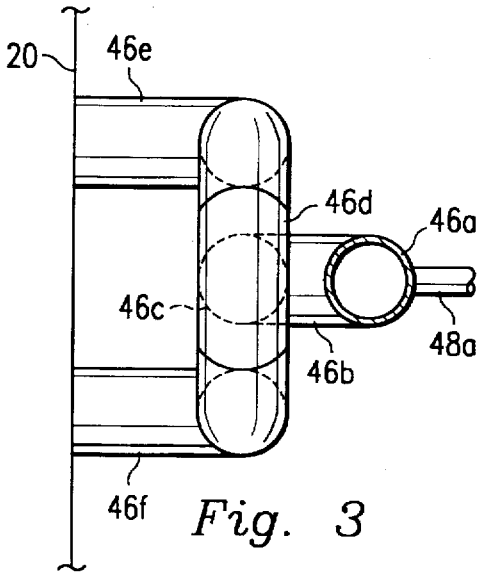
FIG. 3 is a top plan view of the valve of FIG. 2.

The embodiment of FIG. 4 is identical to that of FIGS. 1–3 with the exception that a heat exchanger 60 is disposed adjacent the furnace section 12 and is formed in part by the wall 20 of the furnace section 12 and by a vertical wall 62 extending parallel to the wall 20. The heat exchanger 60 extends between the furnace section 12 and the valve 46 and receives the separated particulate material from the valve through two openings (not shown) formed in the wall 62 which receives the valve legs 46*e* and 46*f*, respectively.

The heat exchanger 60 functions to cool the separated material received from the valve 46 and pass it back to the furnace section and, to this end, it includes a grid 64, which is similar to the grid 34. The grid 64 supports a plurality of nozzles 66 which receive air from a plenum 68 and discharge the air into the heat exchanger 60 to fluidize the material in the heat exchanger. The wall 62 can be formed by a plurality of water tubes as described above and heat exchange tubes (not shown) can be provided in the interior of the heat exchanger 60 to cool the particulate material. The separated material is thus cooled in the heat exchanger 60 by passing water through these tubes after which the cooled material is returned to the furnace section 12 through one or more openings (not shown) provided in the wall 20. The heat exchanger 60 can be of the type disclosed in U.S. Pat. No. 5,523,946 assigned to the assignee of the present invention, the disclosure of said patent being incorporated by reference.

The operation of the embodiment of FIG. 4 is thus identical to that of the embodiment of FIGS. 1–3 with the exception that the material from the pressure seal valve 46 is cooled in the heat exchanger 60 before it is recycled back to the furnace section 12.

It is understood that several other variations may be made in the foregoing without departing from the scope of the invention. For example air can be introduced into the legs 46*c*, 46*d*, 46*e* and/or 46*f* to aerate, and promote the flow of, the separated material through the valve 46 as described above. Also, more than two return legs can connect the leg 46*d* to directly to the furnace section 12 (FIGS. 1–3), or to the heat exchanger 60 (FIG. 4) to reintroduce the separated material into furnace or into the heat exchanger at additional areas thereof.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A pressure seal valve for use in a fluidized bed combustion system including a furnace containing a fluidized bed and a separator for receiving a mixture of flue gases and entrained particulate material from the fluidized bed and separating the particulate material from the flue gases; said valve comprising a downflow leg connected to said separator for receiving said separated material, a lateral leg including an air distribution plate connected to said downflow leg for receiving said separated material, an upflow leg connected to said lateral leg for receiving said separated material, lateral overflow leg connected to said upflow leg for receiving said separated material, at least two return legs extending from said overflow leg for connection to said furnace, and first and second means for introducing air into said valve to aerate said separated material and promote the flow of said separated material through said legs to said furnace, said first means introducing air on a first side of said distribution plate and said second means introducing air on a second side of said distribution plate.

2. A fluidized bed combustion system including a furnace; means for establishing a fluidized bed of combustible particulate material in said furnace; separating means for receiving a mixture of flue gases and entrained particulate material from said fluidized bed in said furnace and separating said material from said flue gases; pressure seal valve means for receiving said separated material from said separating means and establishing a pressure seal to prevent the backflow of said material from said furnace to said separating means; said valve means comprising a downflow leg connected to said separating means for receiving said separated material, first means for introducing air into the downflow leg, a lateral leg connected to said downflow leg for receiving said separated material, second means for introducing air into the lateral leg, an upflow leg connected to said lateral leg for receiving said separated material, a lateral overflow leg connected to said upflow leg for receiving said separated material and means for connecting said overflow leg to said furnace for discharging said separated material into said furnace.

3. The system of claim 2 wherein said connecting means comprises a heat exchanger connected to said furnace and at least two spaced return legs connecting said overflow leg to said heat exchanger.

4. The system of claim 3 wherein said return legs extend downwardly from, and at an acute angle to, said overflow leg.

5. The system of claim 3 wherein said overflow leg comprises a conduit and wherein said return legs each comprises a conduit extending from said overflow leg towards said furnace.

6. The system of claim 2 wherein the height of said separated material in said downflow leg attains a level corresponding to the sum of the pressure drops across said furnace and said separating means.

7. A pressure seal valve for use in a fluidized bed combustion system including a furnace containing a fluidized bed and a separator for receiving a mixture of flue gases and entrained particulate material from the fluidized bed and separating the particulate material from the flue gases; said valve comprising a downflow leg connected to said separator for receiving said separated material, a lateral leg including an air distribution plate, connected to said downflow leg for receiving said separated material, an upflow leg connected to said lateral leg for receiving said separated material, a lateral overflow leg connected to said upflow leg for receiving said separated material, at least two return legs extending from said overflow leg for connection to said furnace, and first and second means for introducing air into said valve to aerate said separated material and promote the flow of said separated material through said legs to said furnace, said first means introducing air directly into said downflow leg and said second means introducing air through said distribution plate.

8. The valve of claim 7 wherein said return legs extend downwardly from, and at an acute angle to, said overflow leg.

9. The valve of claim 7 wherein the height of said separated material in said downflow leg attains a level corresponding to the sum of the pressure drops across said furnace and said separator.

10. The valve of claim 7 wherein said overflow leg comprises a conduit and wherein said return legs each comprises a conduit extending from said first conduit towards said furnace.

* * * * *